US009526278B2

(12) United States Patent
Briggs

(10) Patent No.: US 9,526,278 B2
(45) Date of Patent: Dec. 27, 2016

(54) PROTECTIVE BELT APPARATUS AND CONTROL APPARATUS THEREFOR

(71) Applicant: Aubrey C. Briggs, Sewickley Heights, PA (US)

(72) Inventor: Aubrey C. Briggs, Sewickley Heights, PA (US)

(73) Assignee: Leonard C. Briggs, Sewickley Heights, PA (US)

( * ) Notice: Subject to any disclaimer, the term of this patent is extended or adjusted under 35 U.S.C. 154(b) by 504 days.

(21) Appl. No.: 14/227,582

(22) Filed: Mar. 27, 2014

(65) Prior Publication Data

US 2015/0272248 A1 Oct. 1, 2015

(51) Int. Cl.

| | |
|---|---|
| ***A41D 13/018*** | (2006.01) |
| ***A41F 9/02*** | (2006.01) |
| ***A41F 9/00*** | (2006.01) |

(52) U.S. Cl.

CPC ..... *A41D 13/018* (2013.01); *A41F 9/002* (2013.01); *Y10T 307/76* (2015.04)

(58) Field of Classification Search

CPC ..... A41D 13/018; A41F 9/002; Y10T 307/76; Y10T 307/115

See application file for complete search history.

(56) References Cited

U.S. PATENT DOCUMENTS

| | | | | |
|---|---|---|---|---|
| 5,500,952 | A | 3/1996 | Keyes | |
| 7,017,195 | B2 * | 3/2006 | Buckman | A41D 13/018 2/455 |
| 2006/0288464 | A1 | 12/2006 | Warden | |

FOREIGN PATENT DOCUMENTS

| | | | |
|---|---|---|---|
| WO | 9101658 | A1 | 2/1991 |
| WO | 2005110133 | A1 | 11/2005 |
| WO | 2012104833 | A2 | 8/2012 |

* cited by examiner

*Primary Examiner* — Jared Fureman
*Assistant Examiner* — Rafael Pacheco
(74) *Attorney, Agent, or Firm* — Eckert Seamans Cherin & Mellott, LLC; Brij K. Agarwal

(57) ABSTRACT

A belt apparatus is configured to support the trousers worn by a person and to include a number of airbags that are deployable in a falling event to protect the person from bone breakages. The belt apparatus includes a flexible belt element and a fastener that appear and function in much the same way as an ordinary trouser belt. Despite the ordinary appearance of the belt apparatus, it includes one or more airbags internal thereto whose expansion is controlled by a control apparatus. The control apparatus employs a generator apparatus having a conductor that is movable through a magnetic field to cause a voltage to be induced in the conductor. Responsive to a falling event in a particular direction with respect to the user, the control apparatus triggers the rapid expansion of an airbag that is situated on the belt element in the particular direction with respect to the user.

16 Claims, 9 Drawing Sheets

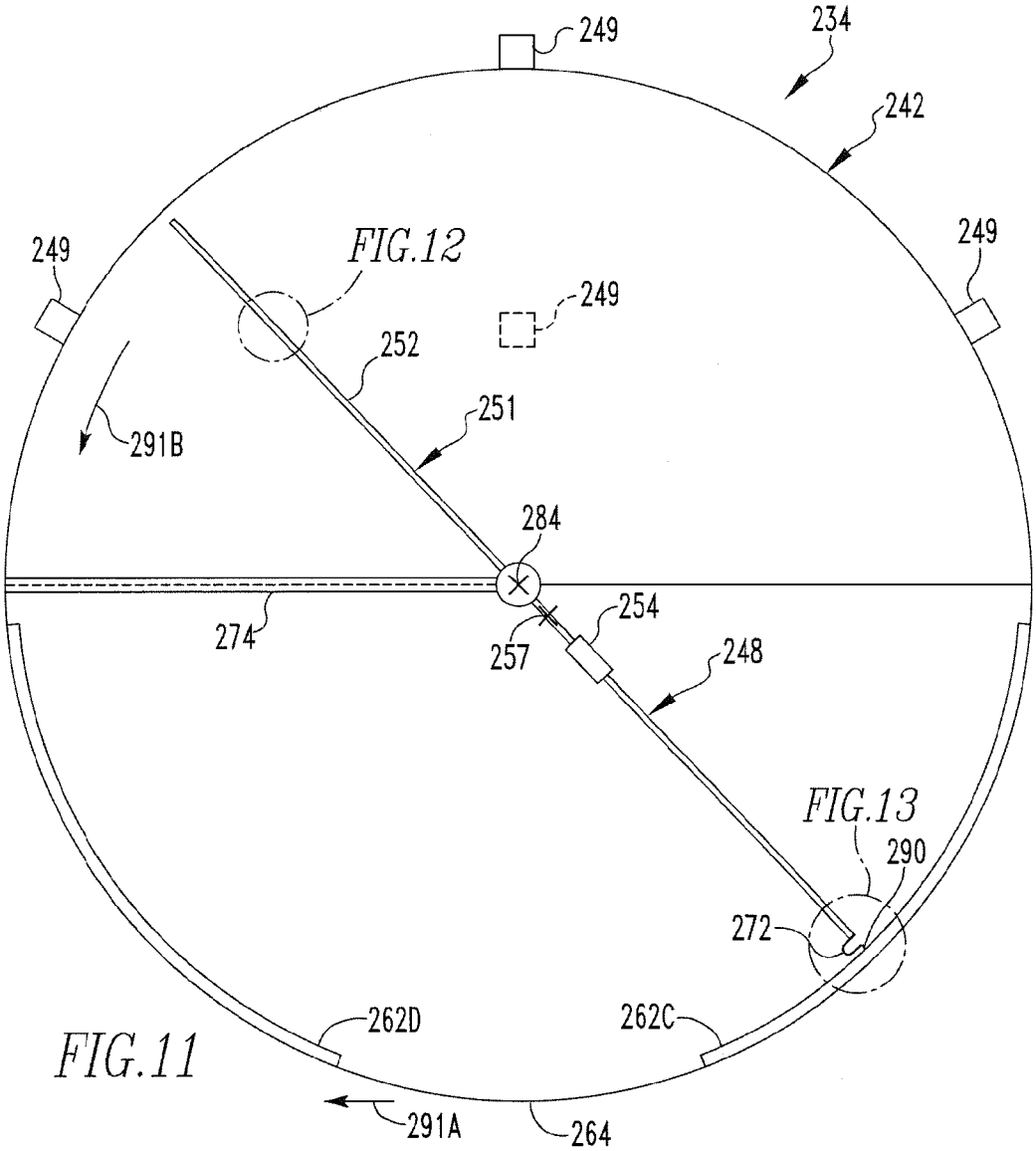
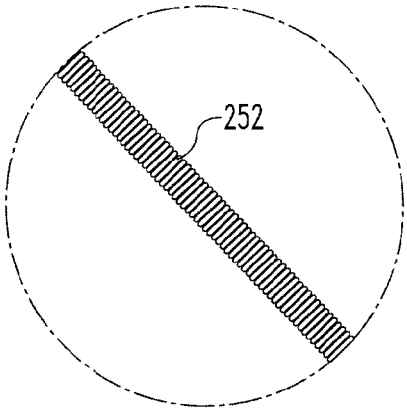
FIG.12
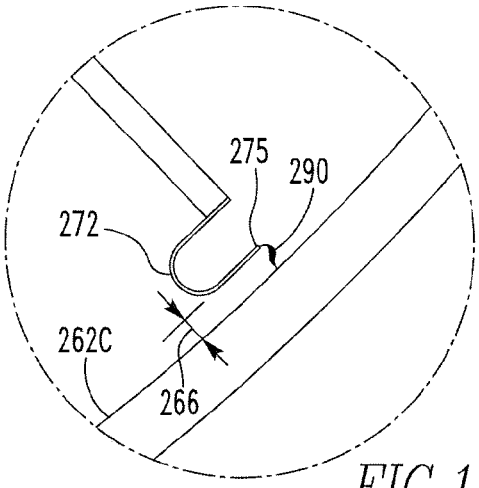
FIG.13

PROTECTIVE BELT APPARATUS AND CONTROL APPARATUS THEREFOR

BACKGROUND

Field

The disclosed and claimed concept relates generally to structures that are intended to protect a person from injury and, more particularly, to a belt apparatus that is structured to resist the breakage of bones as a result of a falling event.

Related Art

A person's bones are understood to gradually become more brittle and thus more subject to breakage as the person ages. It is also understood that a person's muscular tone and strength likewise decreases with age. The loss of muscular tone and strength can, along with other factors, can have a tendency to reduce balance and coordination in an older person, which can contribute to the potential that the person might experience a falling event, i.e., an event wherein the person falls onto a floor, against a wall, or against another object. The reduced muscular tone and strength also reduces the person's ability to catch himself or herself or to otherwise protect himself or herself during a falling event. Furthermore, the aforementioned brittleness of the bones in an aged person increases the likelihood that one or more bones might be broken as a result of a falling event.

It can therefore be said that, as a general matter, aged persons are relatively more likely to experience falling events, and such falling events are likely to involve a relatively greater impact because of the person's inability to catch himself or herself, with the result that an aged person is generally at a greater risk of the breakage of bones than a younger person. It is also generally understood that a significant skeletal break can be sufficiently detrimental to the health of an aged person that the aged person may die from effects that are a direct result of the breakage. At the very least, a significant bone breakage in an older person is detrimental to the person's health due to factors such as the increased potential for infection and the physical resources required to heal the bone break, and also due to the pain and suffering experienced by the person, as well as other factors.

It thus would be desirable to provide a solution that can help people, particularly aged people, to avoid bone breakages that would otherwise be significantly detrimental to the person's health.

SUMMARY

An improved belt apparatus that meets these needs and other needs is configured to support the trousers worn by a person and to include a number of airbags that are deployable in a falling event to protect the person from bone breakages. The belt apparatus includes a flexible belt element and a fastener that appear and function in much the same way as an ordinary trouser belt, i.e., fitting through belt loops in trousers and being fastenable to itself to support the pair of trousers at the waist of the user. Despite the ordinary appearance of the belt apparatus, it includes one or more airbags internal thereto whose expansion is controlled by an improved control apparatus.

The control apparatus employs a generator apparatus having a conductor that is movable through a magnetic field to cause a voltage to be induced in the conductor. The generator apparatus further includes a voltage amplification system that can receive the voltage from the conductor and can generate therefrom a relatively higher voltage that is of sufficient magnitude to energize an airbag. Responsive to a falling event in a particular direction with respect to the user, the conductor moves through the magnetic field with an increased angular velocity, whereby the voltage that is induced therein is of a sufficient magnitude to enable the generator apparatus to trigger the rapid expansion of an airbag that is situated on the belt element in the particular direction with respect to the user. The expansion may be delayed or timed with respect to the initial detection of the falling event to cause the rapid expansion of the airbag to generally coincide with a time just prior to an impact in order to protect those bones of the user that otherwise might have injuriously impacted a floor, a wall, or other structure.

Accordingly, an aspect of the disclosed and claimed concept is to provide a belt apparatus that appears and functions in exactly the same way as a conventional apparel belt or trouser belt, but that additionally protects the user from injury in a falling event.

Another aspect of the disclosed and claimed concept is to provide an improved belt apparatus that is worn by a user in substantially exactly the same fashion that the user would wear a conventional trouser belt.

Another aspect of the disclosed and claimed concept is to provide an improved belt apparatus having a plurality of airbags, which detects a falling event in a particular direction with respect to the user, and which responsively triggers the expansion of an airbag that is situated generally in the particular direction with respect to the user and which thus protects the user and resists the breakage of bones in the particular direction with respect to the user.

Another aspect of the disclosed and claimed concept is to provide an improved belt apparatus which, during a falling event in a particular direction with respect to the user, deploys certain airbags situated generally in the particular direction with respect to the user without necessarily deploying all of the airbags of the belt apparatus.

Another aspect of the disclosed and claimed concept is to provide an improved control system that is usable as a part of an improved belt apparatus having airbags and that employs a movable conductor and a magnetic field to generate the power needed for energizing an airbag and to energize a particular airbag in a direction of a falling event with respect to a user.

Another aspect of the disclosed and claimed concept is to provide an improved control system that can energize an airbag without the need for a battery.

These and other aspects are provided by an improved control apparatus that is structured to electrically trigger at least a first device from among a number of devices. The control apparatus can be generally stated as including a support, a number of electrical contacts, at least some of the electrical contacts of the number of electrical contacts each being electrically connectable with a corresponding device from among a number of devices, a magnetic apparatus comprising at least a first magnetic element that generates a magnetic field, a generator apparatus comprising a movable element that is disposed on the support, the movable element comprising a conductor that is situated in proximity to the magnetic field, responsive to movement of the support, the conductor being inertially movable with respect to the support and to have induced therein a voltage that is of a magnitude that varies with a velocity of the conductor through the magnetic field, and responsive to the voltage being of a predetermined magnitude, the generator apparatus energizing an electrical contact of the number of electrical contacts to thereby electrically trigger the corresponding device that is connected with the electrical contact.

Other aspects are provided by an improved belt apparatus that employs such a control system.

BRIEF DESCRIPTION OF THE DRAWINGS

A further understanding of the disclosed and claimed concept can be gained from the following Description when read in conjunction with the accompany drawings in which:

FIG. 11 is a sectional view as taken along line 11-11 of FIG. 10 of the control system of FIG. 10 in an assembled condition;

FIG. 12 is an enlarged view of the indicated portion of FIG. 11; and

FIG. 13 is an enlarged view of the indicated portion of FIG. 11.

Similar numerals refer to similar parts throughout the specification.

DESCRIPTION

Figure 1:
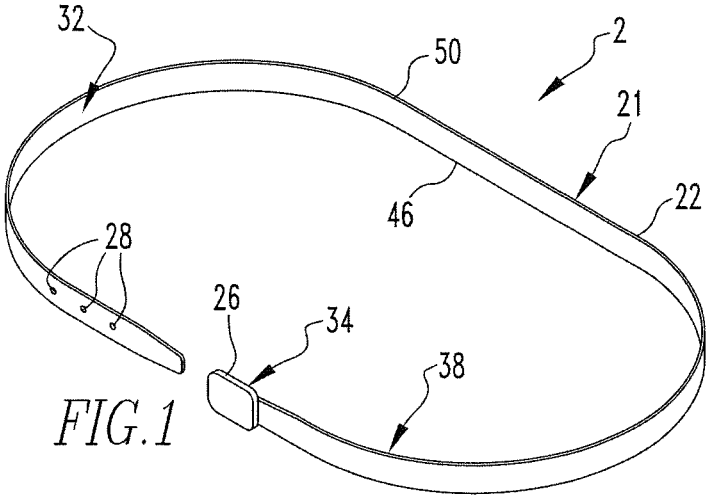
FIG. 1 is a schematic view of an improved belt apparatus in accordance with a first embodiment of the disclosed and claimed concept.
Figure 2:
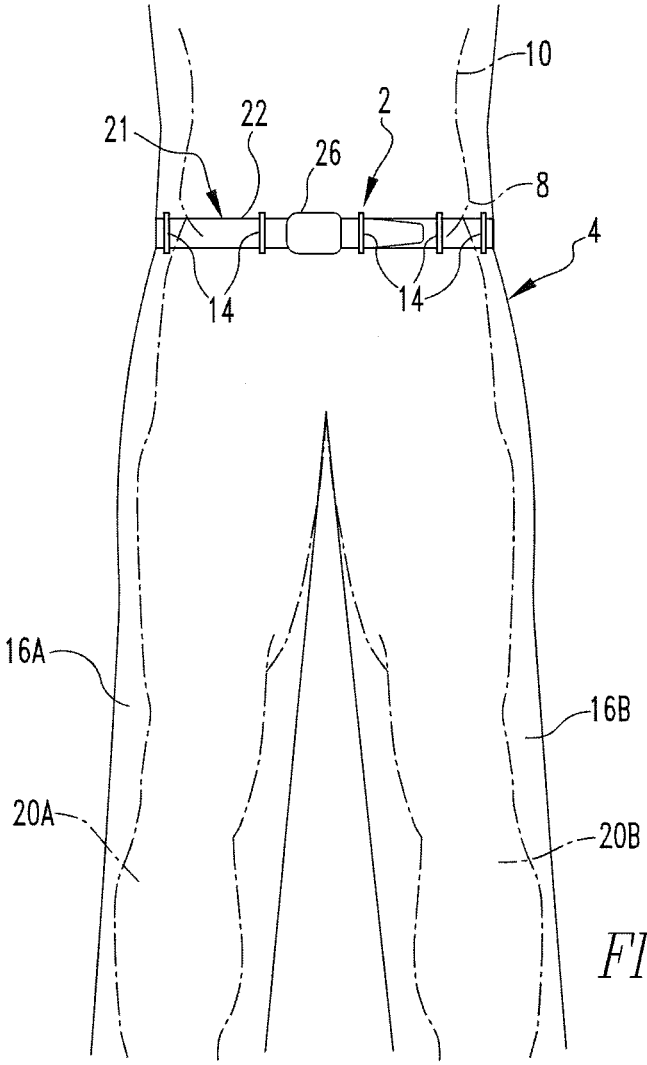
FIG. 2 is a schematic depiction of the belt apparatus of FIG. 1 during ordinary use supporting a pair of trousers at generally the waist of a user.

An improved belt apparatus 2 in accordance with the disclosed and claimed concept is depicted generally in FIGS. 1-3, 7, and 8. The belt apparatus 2 has the appearance and function of a conventional apparel belt or trouser belt but, as will be set forth in greater detail below, is advantageously configured to protect a person from injury as a result of a falling event.

The belt apparatus 2 is configured to support a pair of trousers 4 at approximately the waist 8 of a user 10. The trousers 4 can be conventional items of apparel and can be of any length. The exemplary depicted trousers 4 include a plurality of belt loops 14 and a pair of pant legs 16A and 16B that are intended to clothe a pair of legs 20A and 20B of the user 10. In a conventional fashion, the belt apparatus 2 is received in the belt loops 14 and is fastenable with itself at a selected circumferential length to retain the trousers 4 at the waist 8 of the user 10.

Figure 3:
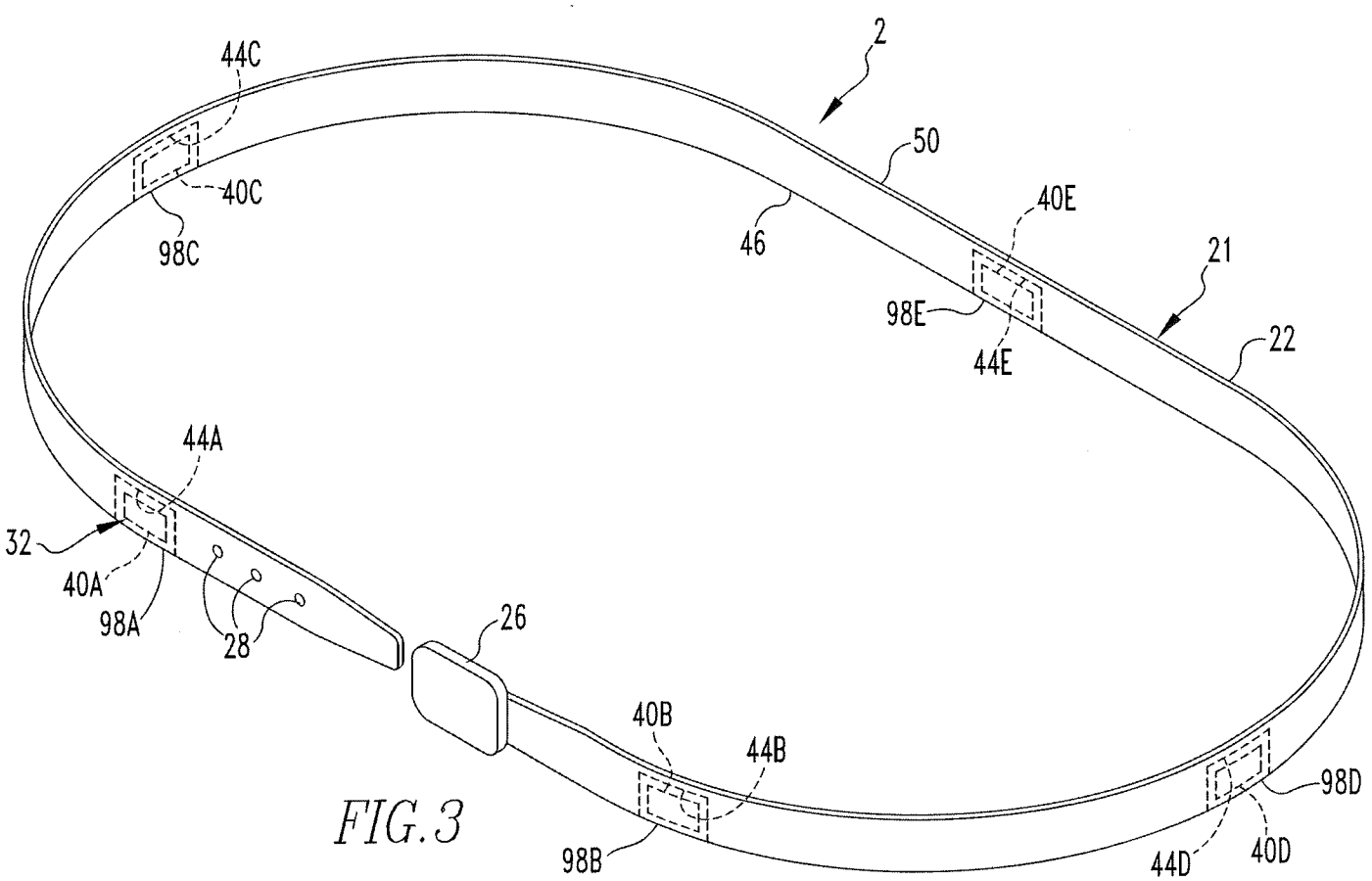
FIG. 3 is another view of the belt apparatus of FIG. 1.

As can be understood from FIGS. 1 and 3, the belt apparatus 2 includes trouser support apparatus 21 that can be said to include an elongated and flexible belt element 22 and a fastener. The fastener is situated at one of the belt element 22 and is in the exemplary form of a buckle 26. The belt element 22 can be formed of any of a wide variety of materials such as leather, canvas, or webbing material, such as in the fashion of a conventional trousers belt and which, in the depicted exemplary embodiment, has a number of holes 28 formed therein in the vicinity of an end of the belt element 22 that is opposite the end where the buckle 26 is situated. As employed herein, the expression "a number of" and variations thereof shall refer generally to any non-zero quantity, including a quantity of one. The exemplary buckle 26 is one having a fixed pin (not expressly shown herein) protruding therefrom that is receivable in one of the holes 28 to retain the belt apparatus 2 and particularly the belt element 22 at a selected circumferential length. It is noted, however, that the belt element 22 and the buckle 26 can be in any of a variety of configurations and can interact with one another in the fashion of any of variety of known conventional trouser belts that are used as apparel without limitation. The belt apparatus 2 is advantageously configured to be usable by the user 10 in essentially exactly the same way as a conventional trouser belt, with the result that the user 10 can be protected from bone breakage in a falling event without having to make any special efforts or take any special actions other than installing the belt apparatus 2 on the trousers 4 in virtually the same way that the user 10 would employ a conventional belt to support the trousers 4.

The belt apparatus 2 additionally includes a protection apparatus 32, a control apparatus 34, and an expansion apparatus 38 that are situated on the trouser support apparatus 21 and that are cooperable to protect the user from injury as a result of a falling event. That is, such apparatuses are cooperable such that, during a falling event, skeletal injuries are advantageously reduced or avoided completely.

Figure 8:
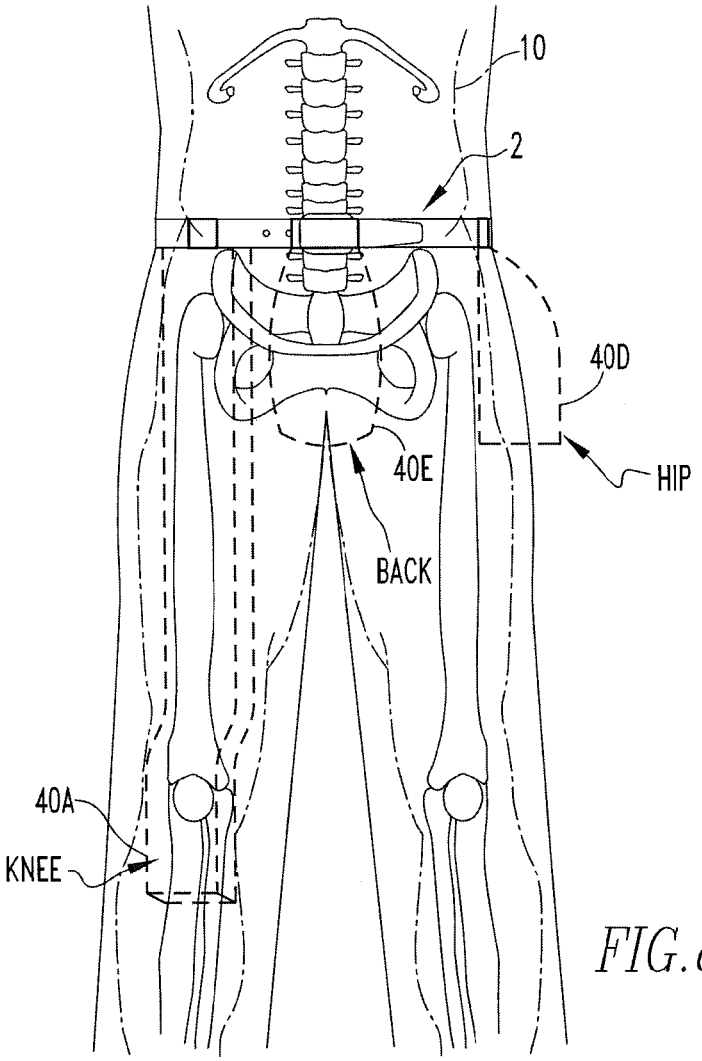
FIG. 8 is a view similar to FIG. 7, except depicting a front elevational view of the belt apparatus and further depicting in dashes lines some of the airbags of the belt apparatus in an expanded configuration.

The protection apparatus 32 includes a plurality of cushion elements 40A, 40B, 40C, 40D, and 40E (collectively referred to herein with the numeral 40) which, in the depicted exemplary embodiment, are embedded within the belt element 22, as is shown in FIG. 3, and are individually expandable by the expansion apparatus 38 under the direction of the control apparatus 34. The cushion elements 40 are depicted in FIG. 3 as being in a collapsed configuration wherein they are each situated substantially entirely within the belt element 22. The cushion elements 40 are generally in the exemplary form of airbags that are expandable by the expansion apparatus 38 from the collapsed configuration depicted generally in FIG. 3 to an expanded condition protruding to the exterior of the belt element 22 and being shaped as is indicated generally in FIG. 8. That is, FIG. 8 generally depicts in dashed lines the cushion elements 40A, 40D, and 40E as each being in their expanded configuration, although in use, as will become apparent, the belt apparatus 2 is unlikely to simultaneously deploy the cushion elements 40A, 40D, and 40E. It is thus understood that FIG. 8 is intended primarily to illustrate the positioning and shapes of the various cushion elements 40 in their expanded configurations.

Figure 4A:
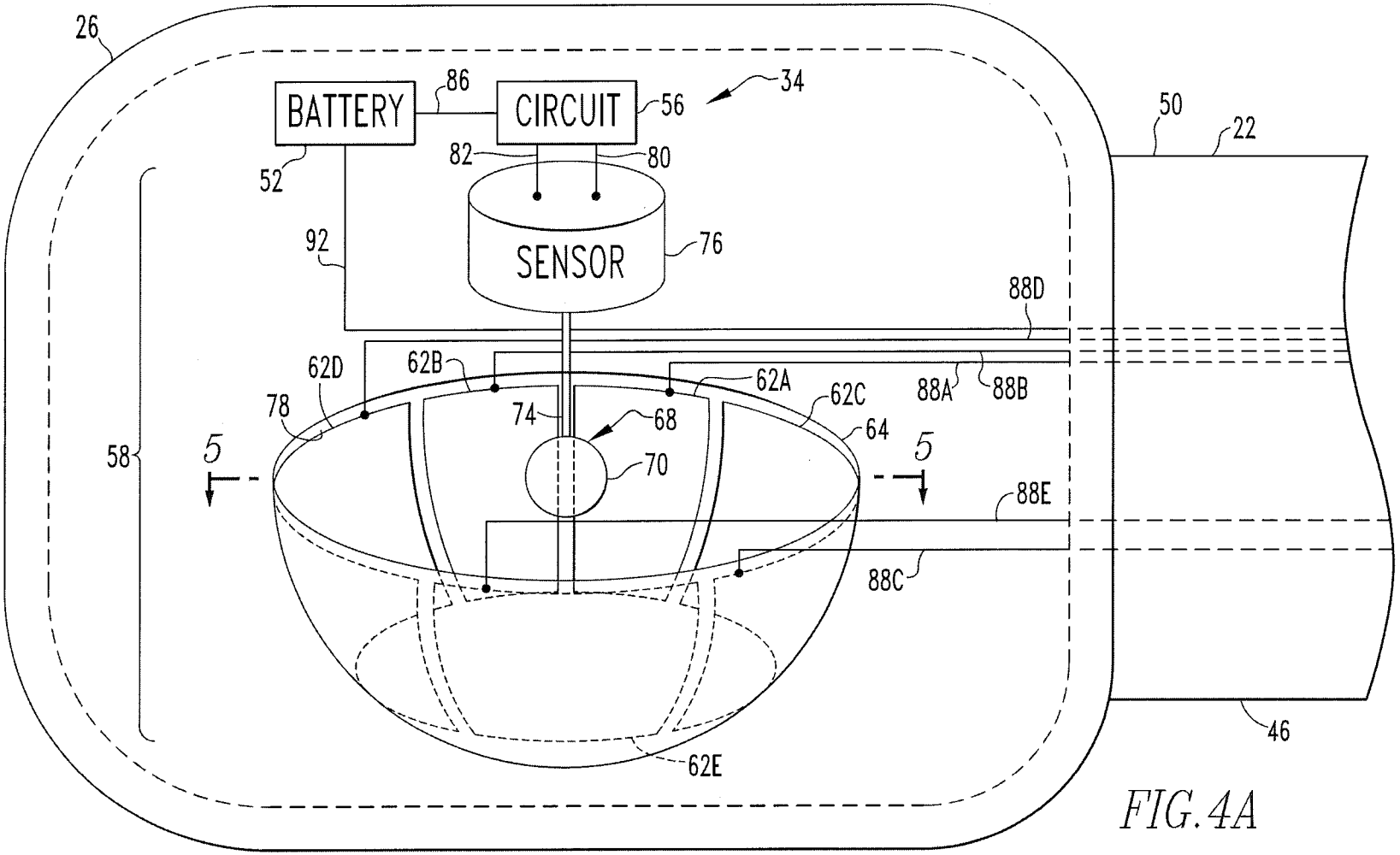
FIG. 4A is a view, partially cut away, of the improved belt apparatus of FIG. 1.
Figure 4B:
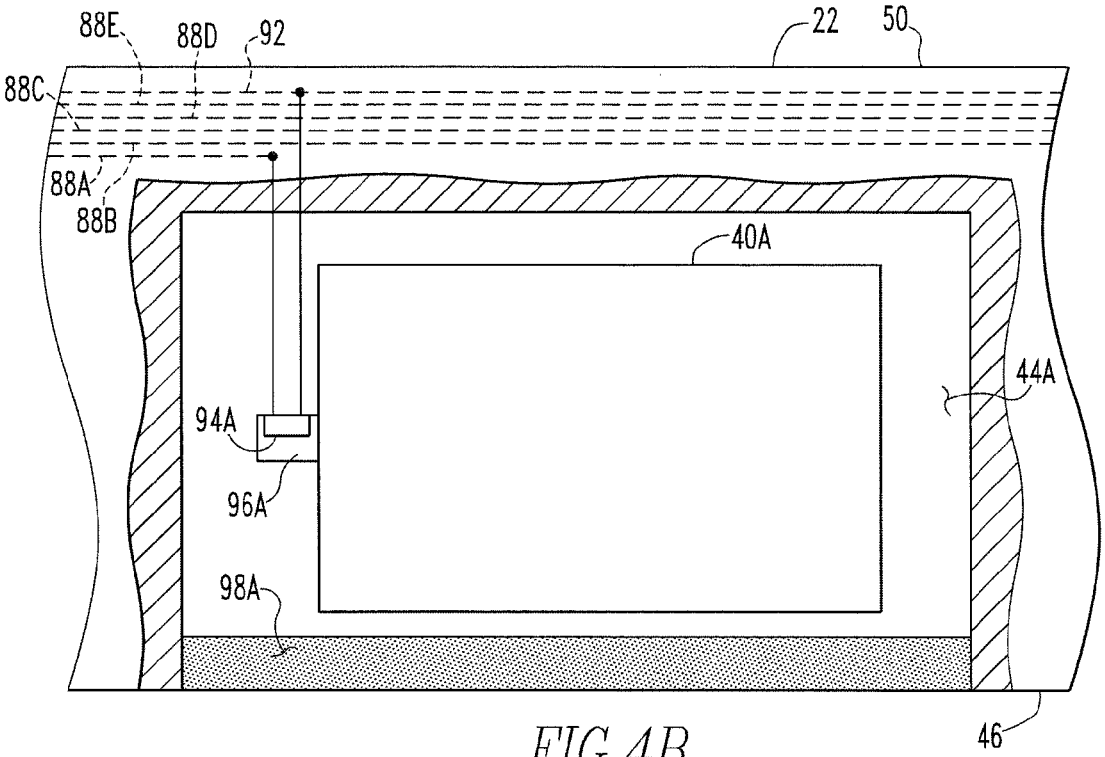
FIG. 4B is a schematic view, partially cutaway, of another portion of the belt apparatus of FIG. 1

As can be understood from FIGS. 3 and 4B, the belt element 22 has a plurality of cavities 44A, 44B, 44C, 44D, and 44E (collectively referred to herein with the numeral 44) formed therein within which the cushion elements 40 are disposed. The belt apparatus 2 can be further said to have an elongated first edge and an elongated second edge 50 opposite one another on the belt element 22. In use, and as can be understood generally from FIG. 8, the first edge 46 is a lower edge of the belt element 22, and the second edge 50 is an upper edge of the belt element 22, both being from the perspective of FIG. 8. The belt element 22 has a length that is significantly greater than its width, i.e., the distance between the first and second edges 46 and 50, and the width is likewise significantly greater than the thickness of the belt element 22 as is depicted generally in FIG. 4C. The cavities 44 are configured such that they retain the cushion elements 40 situated therein in the collapsed configuration without the cushion elements 40 meaningfully affecting the flexibility of the belt element 22, whereby the belt element 22 and the buckle 26 appear to the user 10 and are usable thereby in substantially exactly the same fashion as an ordinary apparel belt of the type that is generally known for retaining trousers at the waist of a user.

In the depicted exemplary embodiment, the control apparatus 34 is situated generally on the buckle 26, and the expansion apparatus 38 is situated generally on the belt element 22. It is understood, however, that different arrangements of the elements described herein can be employed without departing from the present concept.

As can be understood generally from FIG. 4A, the control apparatus 34 can be said to include a power source 52 which in the exemplary embodiment depicted herein is in the form of a small battery of conventional chemistry. The control apparatus 34 further includes a control circuit 56 and a plurality of fall-detection elements 58 that are cooperable with the control circuit 56. The exemplary fall-detection elements 58 include a plurality of contacts 62A, 62B, 62C, 62D, and 62E (collectively referred to herein with the numeral 62) that are situated on a support 64 and further include a pendulum 68 having a mass 70 that is situated at a free end of a flexible support element 74. The number of fall-detection elements 58 can further be said to include a sensor 76 that is connected with the control circuit 56.

The support 64 is generally of a hollow semi-spherical shape having an inner surface 78 that is likewise of a semi-spherical shape. It the contacts 62 are thus each of a partially spherical shape. The contacts 62 are each electronically connected with elements of the expansion apparatus 32 and are operatively connected with the cushion elements 40 to enable them to move from their collapsed configuration to their expanded configuration, as will be set forth in greater detail below.

The mass 70 of the pendulum 68 is a conductive element, i.e. conductive on at least its exterior surface, and is movable about the interior region of the support 64 (which is generally bounded by the contacts 62) while being suspended from the support element 74. In the depicted exemplary embodiment, the support element 74 is likewise electrically conductive and is electrically connected with the mass 70 and is further electrically connected with the control circuit 56 via a lead 80. The sensor 76 is electronically connected with the control circuit 56 via another lead 82, and the power source 52 is electrically connected with the control circuit 56 via a further lead 86. Each contact 62A, 62B, 62C, 62D, and 62E is electrically connected with one of a plurality of leads 88A, 88B, 88C, 88D, and 88E (collectively referred to herein with the numeral 88), respectively. An additional lead 92 is connected with the ground terminal of the power source 52.

The sensor 76 is structured to detect a velocity and/or an acceleration of the mass 70 and/or the support element 74, and such velocity and acceleration can be linear or angular or both. In one exemplary embodiment, the sensor 76 detects the angular velocity of the support element 74 with respect to the sensor 76, and such angular velocity can be referred to with the designation $d\theta/dt$. The sensor 76 can be any of a variety of sensing devices such as accelerometers, optical sensors, eddy current sensors, and the like without limitation. Moreover, the sensor 76 can detect the aforementioned velocity and/or acceleration, linear and/or angular, in any of a variety of fashions. In this regard, and by way of example, it is understood that the sensor 76 might detect the position of the support element 74 or the position of the mass 70 or both as a function of time and from which velocities and accelerations, both linear and angular, can be derived. It thus can be said that the sensor 76 outputs to the control circuit 56 a movement signal that is representative of a velocity or an acceleration or both of the mass 70 and/or the support element 74, it being understood that the actual determination of the velocity and/or acceleration might be calculated by the control circuit 56 itself rather than by the sensor 76.

During ordinary use of the belt apparatus 2, meaning during wearing of the belt apparatus 2 by the user 10, the mass 70 remains suspended on the support element 74 and freely moves about within the interior of the support 64 and potentially comes into electrical engagement with one or more of the contacts 62. Such electrical engagement between the mass 70 and one or more of the contacts 62 does not necessarily cause any other actions to occur on the belt apparatus 2. This is because the control circuit 56 is advantageously configured to ignore daily occurrences that are not falling events. For example, a person may move from a standing position to a sitting position, and the $d\theta/dt$ of such an event is less than that which would indicate a falling event. The control circuit 56 effectively ignores such events as being indicative of false alarms, i.e., occurrences that appear to share some characteristics with a fall but that are not falling events. Other types of occurrences that are ignored as false alarms would include riding on an amusement park ride such as a roller coaster, driving in an automobile over a bumpy road, shooting a firearm, etc. In this regard, the control circuit 56 may employ logic that includes representations of a number of predetermined events, such as those set forth in the preceding sentence, which are automatically ignored as false alarms.

However, if the signal from the sensor 76 is interpreted by the control circuit 56 to be indicative of an initiation of a falling event, the control circuit 56 generates a triggering signal which is communicated to the mass 70 through the lead 80 and the support element 74. When the mass 70 electrically engages one of the contacts 62, the triggering signal is communicated through the engaged contact 62 and is further communicated therefrom as a directional triggering signal along the lead 88 that is connected with the engaged contact 62.

Figure 6:
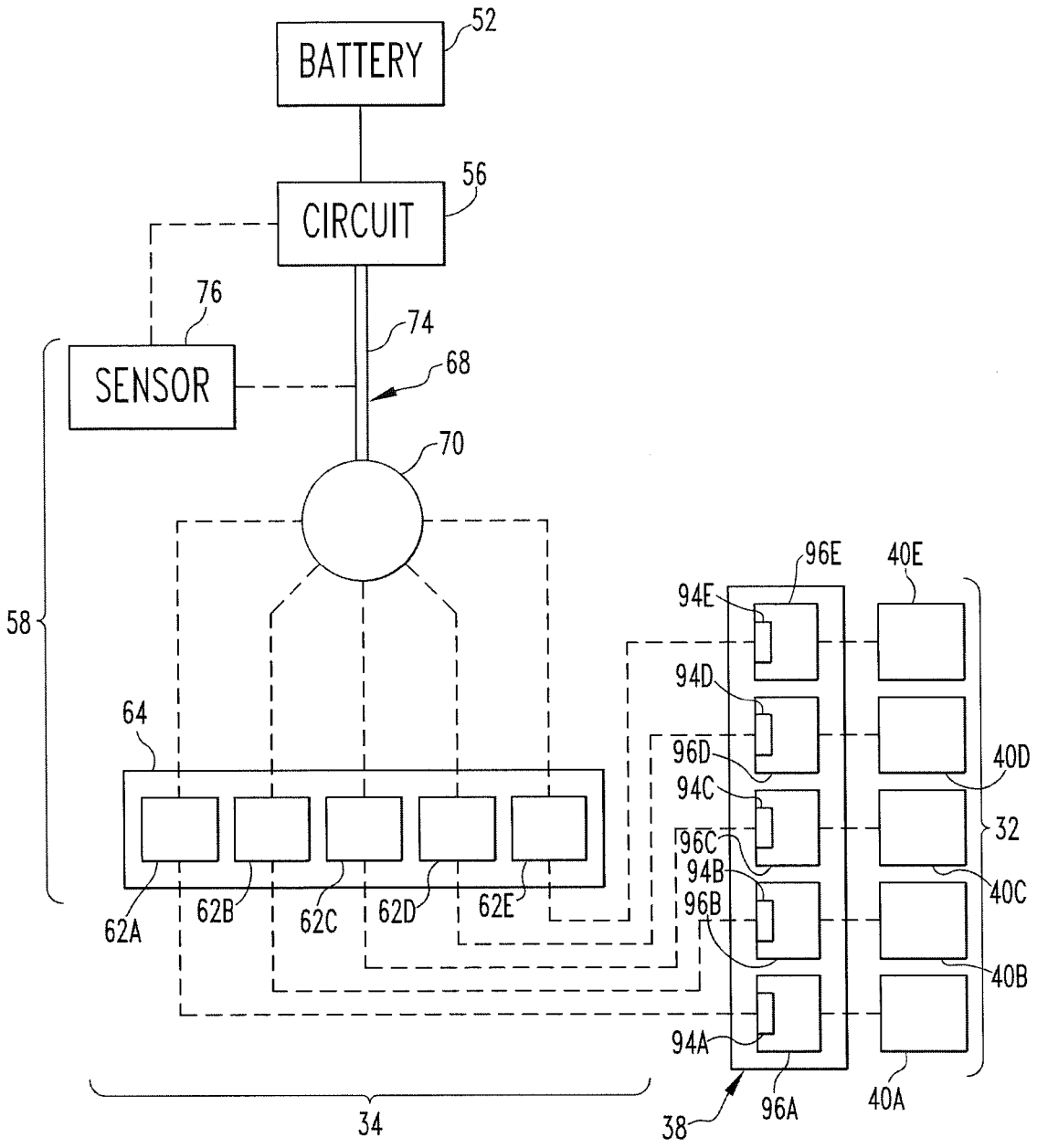
FIG. 6 is a schematic depiction of portions of a control apparatus of the belt apparatus of FIG. 1.

As can be understood from FIG. 6, the expansion apparatus 38 includes a plurality of igniters 94A, 94B, 94C, 94D, and 94E (collectively referred to herein with the numeral 94) that are configured to ignite separate amounts of propellant 96A, 96B, 96C, 96D, and 96E (collectively referred to herein at the numeral 96). The exemplary propellant 96 employed herein is sodium azide ($NaN_3$) which, when ignited by one of the igniters 94, rapidly generates a large volume of nitrogen gas ($N_2$) that is used to move a corresponding cushion element 40 from its collapsed configuration to its expanded configuration, such as in the fashion of an automobile airbag. When the directional triggering signal is communicated along one of the leads 88 to a corresponding igniter 94, it ignites the associated charge of propellant 96.

Figure 4C:
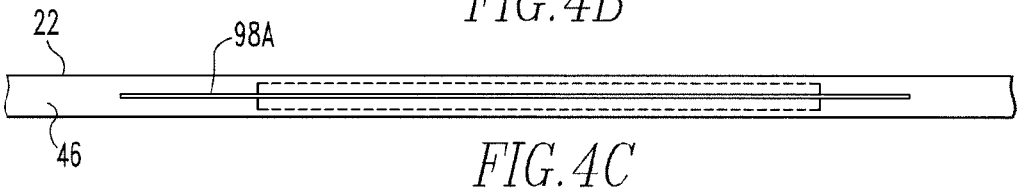
FIG. 4C is a view from another perspective of the portion of the belt depicted generally in FIG. 4B.

The cushion elements 40 are each in the form of generally enclosed bags that either have the propellant 96 situated therein or that have an opening through which the nitrogen gas generated by the propellant 96 can be introduced into the interior of the cushion element 40. As such, the nitrogen gas that is rapidly generated by the propellant 96 expands the corresponding cushion element 40 from the collapsed configuration to the expanded configuration with explosive force. The belt element 22 thus is formed to include a plurality of frangible regions 98A, 98B, 98C, 98D, and 98E (indicated schematically in FIG. 3 and collectively referred to herein with the numeral 98) that are situated generally at the first edge 46 and extend at least slightly into the interior of the belt element 22, as can be seen more particularly with the frangible region 98A in FIG. 4B. The frangible regions 98 are generally closed when the cushion elements 40 are in their collapsed configuration, as can be seen in FIG. 4C, and such frangible regions 98 can be retained in such a closed condition through the use of adhesives, fastening structures, or in any of a wide variety of understood fashions. Upon ignition of the charge of propellant 96 associated with any cushion element 40, the nitrogen gas that is generated by the propellant 96 expands the associated cushion element 40 with explosive force which causes the associated frangible region 98 to break or otherwise separate, which thereby permits the cushion element 40 to protrude out of the frangible region 98 to the exterior of the belt element 22 in protective proximity with a portion of the body of the user 10. It thus can be understood that the control apparatus 34 is configured to detect that a falling event is occurring in a particular direction with respect to the user 10 and is further configured to generate a directional trigger signal which causes the expansion apparatus 38 to deploy at least one cushion element 40 that is situated in the particular direction with respect to the user 10. This desirably interposes the deployed cushion element 40 between a body part of the user 10 and another object such as a floor, a wall, or another object.

The cushion elements 40 are desirably rapidly expanded, i.e., inflated by the nitrogen gas from the ignited propellant 96, but are also desirably deflated promptly thereafter in order to avoid the user 10 rebounding from the expanded cushion element 40. That is, the expanded cushion element 40 advantageously absorbs some of the energy of the fall, thereby allowing the user 10 to contact the floor, the wall, etc. with far less energy than would occur in the absence of the belt apparatus 2. The fall is desirably of sufficiently low energy that the breakage of bones is avoided. The deflation of the cushion element 40 is thus intended to dissipate the absorbed energy to thereby avoid the cushion element acting like a spring and redirecting any energy that has been absorbed back into the user 10, which might cause the user to fall in another direction with the same energy or which might itself cause a bone breakage if such energy is not dissipated. The cushion elements 40 are thus advantageously formed of 6-6 nylon that is woven in a fashion that it is reactive to the explosive expansion of the gases generated by the propellant 96 but that have sufficient spacing among the fibers thereof to permit the gas to escape through the interstices of the fabric of the cushion element 40, such as in the fashion of an automobile airbag.

Figure 7:
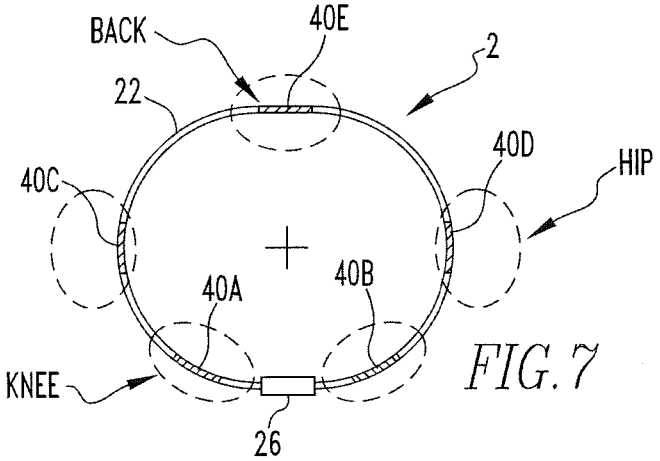
FIG. 7 is a schematic top plan view of the belt apparatus of FIG. 1 as it would be situated on the user, as in FIG. 2.

The positioning and configuration of the various cushion elements 40 is depicted generally in FIGS. 7 and 8. The cushion element 40A is intended to protect the right knee of the user and is depicted in an expanded configuration in FIG. 8A. The cushion element 40B is a mirror image of the cushion element 40A and is intended to protect the left knee of a user. When the belt apparatus 2 is worn by the user 10, the cushion elements 40A and 40B are situated generally anterior to the user 10. As can be understood generally from FIG. 8, the cushion elements 40A and 40B can each be said to include a first elongated region which, when expanded, is intended to extend from the belt apparatus 2 and along the femur toward the knee. The cushion elements 40A and 40B each further have a second elongated region distal to the first elongated region that is offset from the first elongated region and is intended to be in protective proximity of the knee.

The cushion elements 40C and 40D are relatively wider than the cushion elements 40A and 40B and are intended to protect the right and left hips, respectively, of the user 10. The cushion element 40D is depicted generally in FIG. 8 in its expanded configuration. The cushion element 40C in its expanded configuration is a mirror image of cushion element 40D. In use, the cushion elements 40C and 40D are situated generally laterally with respect to the user 10. The relatively shorter but wider configuration of the cushion elements 40C and 40D when compared with the cushion elements 40A and 40B enables the cushion elements 40C and 40D to protect, for instance, the right and left pelvic arches, respectively, during a falling event.

The cushion element 40E is generally rectangular in shape and is intended to protect the pelvis and lower spine, as is indicated in FIG. 8. The cushion element 40E is thus situated at the posterior of the user 10 when the belt apparatus 2 is worn by the user 10.

While the cushion elements 40 are described herein as each being extendable (in the expanded configuration) through a corresponding frangible region 98 situated at the first edge 46, it is understood that the cushion elements 40 can extend through other types of frangible regions or may be otherwise retained on the belt element 22 while still providing the protective proximity to the various body parts described above. Moreover, the exemplary depicted cushion elements 40 or other types of cushion elements that are intended to protect other parts of the body can extend from other portions of the belt element 22. For example, an additional cushion element might be configured to expand in a direction opposite the direction of expansion of the cushion element 40E and may be configured to protect the lumbar and thoracic spine of the user 10, by way of example. Other types of cushion elements can be envisioned.

As set forth above, the cushion elements 40 are each configured to be inflated rapidly. Upon ignition of the propellant 96, the gases generated thereby can cause the related cushion elements 40 to expand nearly instantaneously. Since the cushion elements 40 also desirably deflate promptly after expansion, the ignition of the propellant 96 is desirably timed to coincide with roughly the time at which the user 10 is about the strike the ground or another object subsequent to the onset of the falling event. That is, acceleration due to gravity is a well understood concept, and is understood that the knees, hips, and pelvis of a user in the midst of a falling event typically fall toward the ground at velocities slower than would be experienced purely due to gravity since the knees, hips, and pelvis of the user 10 most typically move about other body structures during the falling event. That is, the knee is situated atop the tibia and fibula of the user and these bones are situated atop the ankle of the user. During a fall, the tibia and fibula typically will pivot at least somewhat about the ankle or at least with respect to the ground. The hips and pelvis are situated atop the femurs of the user and likewise pivot about the ankle and potentially the knee during a falling event.

The result is that the knees, hips, and pelvis of the user move toward the ground during a falling event at velocities that are less than that which would ordinarily result purely from the acceleration due to gravity. Since the ignition of the propellant 96 causes the corresponding cushion elements 40 to expand nearly instantaneously, the ignition of the propellant 96 is desirably timed, i.e., delayed, so that the cushion element 40 is expanded into protective proximity with the protected body part just prior to the time at which the protected body part would otherwise strike the ground. This is done in order to enable the protected body part to experience the maximum protection afforded by the expanding cushion element 40, which would occur generally at the point where the cushion element 40 reaches a state of complete expansion and just prior to the point at which the expansion of gases from the propellant 96 ceases and the cushion element 40 begins to deflate.

The control apparatus 34 thus delays the outputting of the trigger signal by a short period of time that is intended to cause the expansion of the cushion elements 40 to be at their aforementioned maximum protective capability immediately prior to the user striking, for instance, the ground. In the depicted exemplary embodiment, the trigger signal is output from the control apparatus 34 as a delayed trigger signal which is timed to cause the one or more cushion elements 40 that are in the direction of the falling event to be completely expanded at approximately 0.03 seconds after the initiation of the falling event. Such a delay may be adjusted depending upon the perceived velocity of the falling event which can be derived from the aforementioned $d\theta/dt$ signal obtained from the sensor 76, although other indicators and/or data can be employed to determine the amount of delay needed for a particular falling event. The delay in the generation of the delayed trigger signal is desirably timed such that the following action are accomplished immediately prior to the body part striking, for instance, the ground: the control circuit 56 generates the directional trigger signal, which is communicated to the corresponding igniter 94, which ignites its associated propellant 96, which expands the corresponding cushion element 40, which breaks the associated frangible region 98, and which expands into protective proximity of the protected body part. The exemplary total time is described as being approximately 0.03 seconds. Since the delayed trigger signal generated by the control circuit 56 is communicated at substantially the speed of light to the corresponding igniter 94, it can be understood that the time required for ignition of the propellant 96 and expansion of the corresponding cushion element 40 is a significant factor in determining the appropriate delay.

Figure 5:
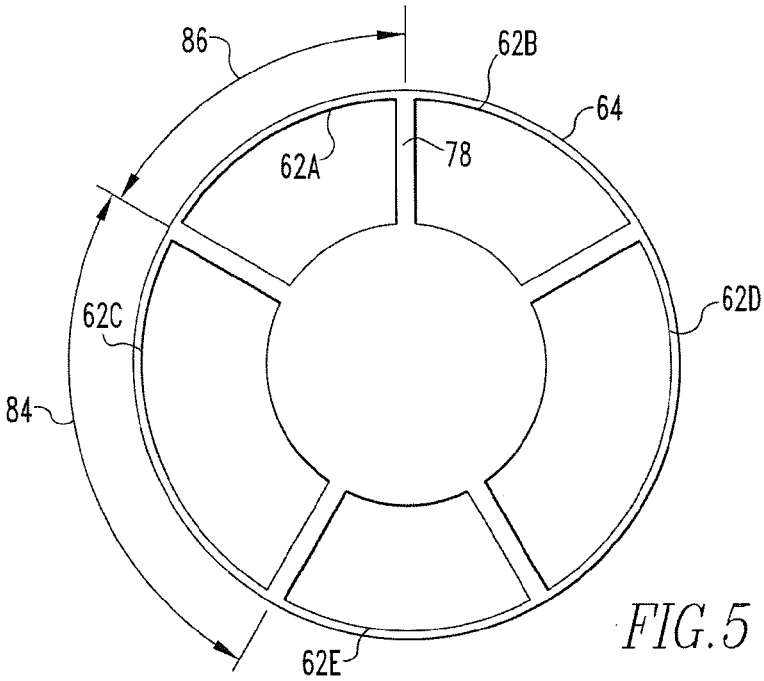
FIG. 5 is a sectional view as taken along line 5-5 of FIG. 4A.

As can be understood from FIGS. 4A and 5, the various contacts 62 are positioned about the support 64 in such a fashion that each contact 62 will be contacted by the mass 70 depending upon the direction of the falling event with respect to the user. The spaces between adjacent contacts 62 are exaggerated herein, and it is therefore understood that a given falling event may be in such a direction that the mass 70 electrically engages two of the contacts 62 that are adjacent one another, in which case the two corresponding cushion elements 40 will be expanded into protective proximity with their protected body parts. In this regard, the mass 70 may itself be somewhat flexible or may contain conductive structures that facilitate the contacting of more than one contact 62 by the mass 70 in order to provide a greater degree of protection to the user 10.

As can further be seen from FIG. 5, the contacts 62 need not each occupy an equal portion of the perimeter of the support 64. By way of example, the contacts 62C and 62D, which protect the hips of the user 10, may occupy a relatively larger portion (as indicated at the numeral 84 in FIG. 5) of the perimeter of the support 64 than the contacts 62A and 62B (as indicated at the numeral 86 in FIG. 5) and the contact 62E. This may be desirable due to, for example, the potential to break the hips from a large range of directions with respect to the user 10. Other configurations of the contacts 62 will be apparent.

It thus can be seen that the improved belt apparatus 2 is advantageously configured to appear and function during ordinary use in a fashion that is generally indistinguishable from an ordinary trouser belt, which encourages a user to regularly wear the belt apparatus 2 since no additional thought is required beyond the thought that is necessary in putting on and wearing an ordinary belt. The belt apparatus 2 is thus deployable to protect a person from injury due to bone breakage as a result of a fall.

It is noted that the belt loops 14 of the trousers 4 desirably might be configured to avoid interference with expansion of the various cushion elements 40. For example, the belt loops 14 might be positioned so that they do not overlap any of the cushion elements 40. Alternatively or additionally, the belt loops 14 may be configured with a relatively weak attachment at the point of connection with the trousers at the lower end, i.e., the end which would be adjacent the first edge 46 of the belt element 22. Still additionally or alternatively, the protection apparatus 32 and/or the expansion apparatus 38 may be configured such that the belt loops 14 simply serve as additional frangible elements that are intended to be torn or detached from the trousers 4 by the explosive power of the ignited propellant 96.

Figure 9:
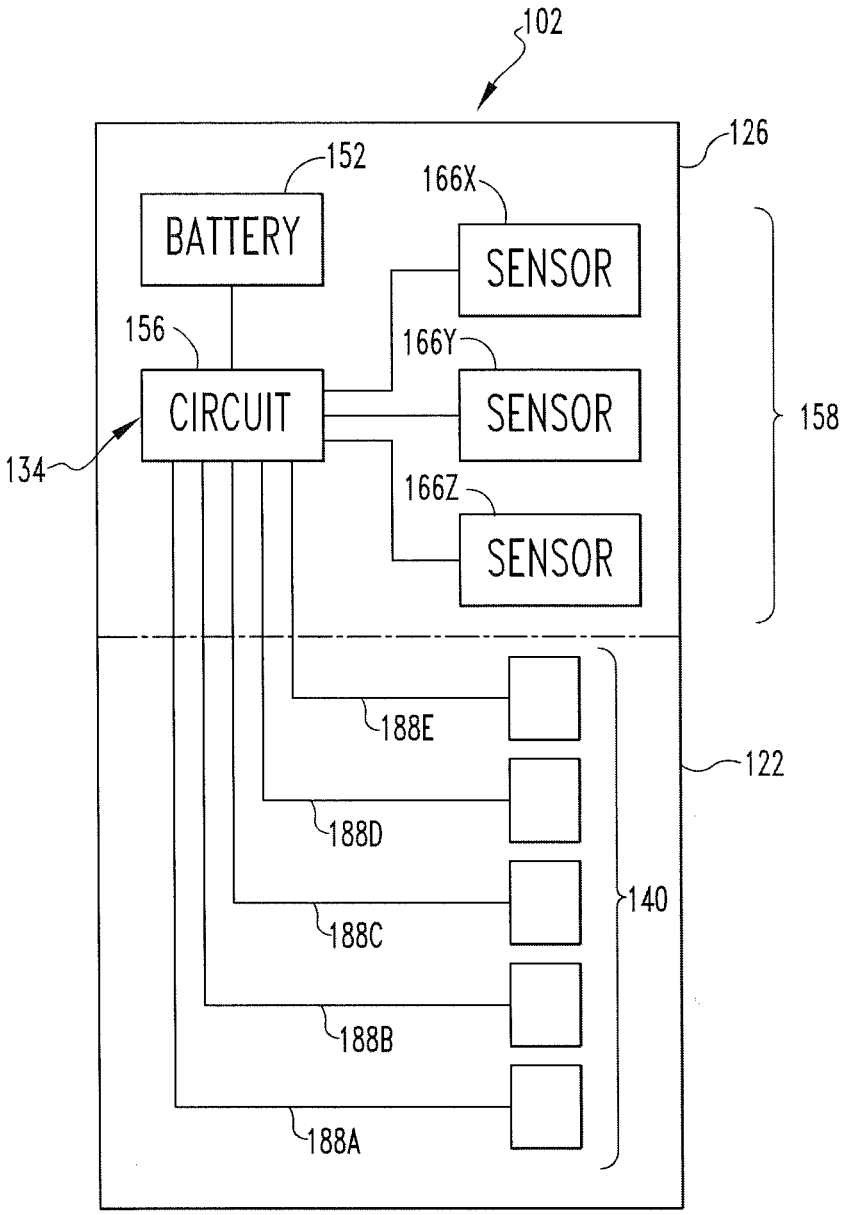
FIG. 9 is a schematic depiction of an improved belt apparatus in accordance with a second embodiment of the disclosed and claimed concept.

FIG. 9 schematically depicts an improved belt apparatus 102 in accordance with a second embodiment of the disclosed and claimed concept. The belt apparatus 102 is essentially identical to the belt apparatus 2, except that the belt apparatus 102 includes a different control apparatus 134. The control apparatus 134 is still situated on a buckle 126 of the belt apparatus 102, and a belt element 122 extends from the buckle 126. However, while the control apparatus 134 can be said to include a control circuit 156 and a number of fall detection elements 158, the exemplary number of fall detection elements 158 of the belt apparatus 102 comprise a number of sensors 166X, 166Y, and 166Z (collectively referred to herein with the numeral 166) which are each in the exemplary form of an accelerometer. That is, the sensors 166 might be accelerometers that are oriented orthogonal to one another, or they may be other types of sensors. Moreover, the sensors 166 need not necessarily be situated orthogonal to one another, and it is possible that a lesser quantity of accelerometers or other sensors can be oriented in various directions from which sufficient signals can be input to the control circuit 156 to enable the control circuit 156 to identify the onset of a falling event. The control circuit 156 likewise provides a delayed trigger signal that is timed to coincide with a moment just prior to the user striking, for example, the ground, and the trigger signal is moreover a directional trigger signal which causes expansion of one or more of a plurality of cushion elements 140A, 140B, 140C, 140D, and 140E (collectively referred to herein with the numeral 140). The cushion elements 140 are connected with the control circuit 156 via a number of directional trigger connections which, in the depicted exemplary embodiment, include a plurality of leads 188A, 188B, 188C, 188D, and 188E (collectively referred to herein with the numeral 188) that are each connected with a corresponding one of the cushion elements 140.

It is understood, however, that the connections between the control circuit 156 and the various cushion elements 140 could be provided other than through the use of the individual dedicated leads 188. For example and depending upon the capability of the power source 152, it may be possible to provide a wired or wireless network which may or may not continually communicate signals between the control circuit 156 and the cushion elements 140 to cause one or more particular cushion elements 140 to be expanded in response to a detection of a falling event. For instance, the control circuit 156 might additionally include an RF transmitter that communicates a delayed and directional trigger signal to a particular receiver associated with a particular cushion element 140 to cause the particular cushion element 140 to expand in response to a falling event. By way of further example, instead of providing individual wires or leads that extend along the belt element 122 between the control circuit 156 and the various cushion elements 140, the belt apparatus 102 may employ a single set of leads that are heavier and that continually provide signals to the bags 140 and which, in response to a falling event, can include signals which include an instruction that one or more of the cushion elements 140 are to be expanded. Thus, the belt apparatus 2 may include wired and/or wireless networks that are used to expand the cushion elements 140. Other variations will be apparent.

Figure 10:
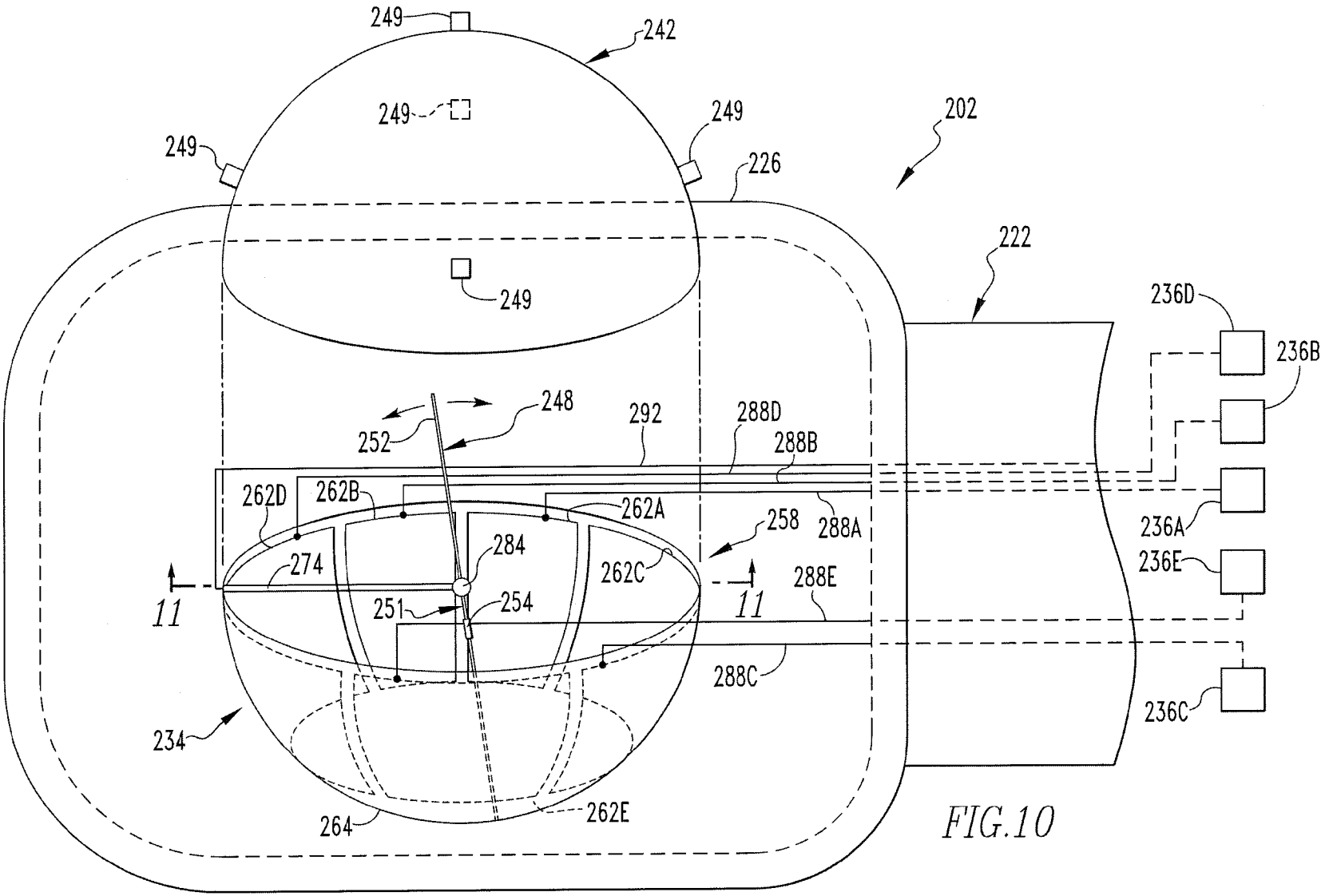
FIG. 10 is an exploded depiction of an improved belt apparatus having an improved control system in accordance with a third embodiment of the disclosed and claimed concept.

An improved belt apparatus 202 in accordance with a third embodiment of the disclosed and claimed concept is depicted generally in FIGS. 10-12. The belt apparatus 202 is in some fashions similar to the belt apparatuses 2 and 102 in that it includes an elongated belt element 222 at one end of which is situated a buckle 226. Advantageously, however, the belt apparatus 202 includes an improved control apparatus 234 in accordance with the disclosed and claimed concept that generates its own electrical power. The control apparatus 234 is connected with a plurality of protective devices 236A, 236B, 236C, 236D, and 236E, which may individually or collectively be referred to herein with the numeral 236. The protective devices 236 are airbags that are much the same as the protective devices of the belt apparatus 2. Each such protective device 236 includes a propellant, an igniter which is operable to convert the propellant into a gas, and a cushion element that is expanded by the gas. It is noted, however, that the protective devices 236 are each schematically depicted herein as being unitary for reasons of simplicity of disclosure. Just as with the belt apparatus 2, each protective device 236 is configured to expand in a protective fashion responsive to an electrical trigger signal.

The control apparatus 234 is situated on the buckle 226 and can be said to include a magnetic apparatus 242 and a generator apparatus 248. The magnetic apparatus 242 includes a number of magnetic elements 249 which, in the depicted exemplary embodiment, are permanent magnets, although other types of magnets can be employed without departing from the present concept. The magnetic elements 249 are arranged in a generally partially spherical arrangement and each have their north poles pointed at a vertex of the spherical shape. The magnetic elements 249 together create a magnetic field. In other embodiments, the magnetic elements 249 could instead have their south poles each pointed at the vertex of the spherical shape. The magnetic elements 249 are depicted herein as being situated on a partially spherical supporting structure, but it is understood that the magnetic elements 249 could be mounted to any structure, including the buckle 226, so long as they are arranged with either all of the north poles or all of the south poles being pointed toward a common point.

The generator apparatus 248 can be said to include a movable element 251 that is pivotably situated on a spherical end of a stationary brace 274. In the depicted exemplary embodiment, the brace 274 is depicted as being affixed to a semi-spherical support 264 that is disposed on the buckle 226. The exemplary brace 274 supports the movable element 251, and it is understood that numerous other arrangements for supporting the movable element 251 can be provided without departing from the present concept. In the depicted exemplary embodiment, the spherical end of the pivot point 284 is formed from a ruby or other jewel, whether natural or artificial, such as in the manner of a jeweled watch movement. This enables the movable element 251 to remain movably situated on the brace 274 while avoiding whatever friction may exits therebetween from wearing either of the movable element 251 and the brace 274. This advantageously enables continued pivotable movement of the movable element 251 with respect to the brace 274 over extended periods of time such as years.

As can be understood from FIGS. 10 and 11, the movable element 251 is pivotably situated on the brace 274 and pivots about a pivot point 284. The pivot point 284 is situated at the vertex of the spherical arrangement of the magnetic elements 249 whereby the north poles of the magnetic elements 249 are each oriented generally at the pivot point 284. In use, the movable element 251 is generally freely pivotable with respect to the brace 274 and the buckle 226.

The generator apparatus 248 includes an elongated conductor 252 that is a part of the movable element 251 and that is disposed in proximity to the magnetic field that is generated by the magnetic elements 249. In the depicted exemplary embodiment, the conductor 252 is formed of copper, but other conductive materials can be employed to form the conductor 252 without departing from the present concept. As can be understood from FIG. 12, the exemplary conductor 252 is formed of a plurality of windings, such as in the nature of a coil spring, in order to effectively increase the length of the conductive element that forms the conductor 252 while maintaining the conductor 252 as a physically small element that can be retained internally within the buckle 226.

Since the conductor 252 is situated in proximity to the magnetic field that is generated by the magnetic apparatus 242 (which affixed to the buckle 226), and because the conductor 252 is movably disposed on the brace 274 and is thus likewise movable with respect to the magnetic apparatus 242 and the magnetic field it generates, it can be understood that movement of the movable element 251 with respect to the magnetic field results in a voltage being induced in the conductor 252. The induced voltage can also result in another magnetic field being formed about the movable element itself.

As can be generally understood, the induced voltage in the conductor 252 will be based at least in part upon the velocity of the conductor 252 in moving with respect to and through the magnetic field, and in the depicted exemplary embodiment the velocity will be an angular velocity. As can be generally understood, as the angular velocity of the conductor 252 with respect to the magnetic field increases, so does the voltage that is induced in the conductor 252.

It is expressly noted that the control apparatus 234 is situated on the buckle 226, and that the buckle 226 is movable in three-dimensional space inasmuch as the user who wears the buckle 226 is likewise movable. It is also expressly noted that the movable element 251 is freely movable on the brace 274 and is suspended thereon in such a fashion that gravity retains the movable element 251 in a condition generally vertical in three-dimensional space. It thus can be understood that the interaction between the movable element 251 and the magnetic field of the magnetic apparatus 242 is actually that the magnetic field moves with respect to generally stationary the movable element 251. It is reiterated, however, that the aforementioned voltage that is induced in the movable element 251 is the result of relative movement between the movable element 251 and the magnetic field, and it is therefore noted that such relative movement in intended regardless of whether the movable element 251 is characterized herein as moving with respect to the magnetic field or whether the magnetic field is characterized herein as moving with respect to the movable element 251.

The generator apparatus 248 additionally includes a voltage amplification system 254 that is schematically depicted in FIGS. 10 and 11 as being situated on the movable element 251 and as being spaced from the pivot point 284. The voltage amplification system 254 has a certain amount of mass, and the spacing of the voltage amplification system 254 from the pivot point 284 results in the movable element 251 having a center of mass 257 that is likewise spaced from the pivot point 284 and that is disposed generally between the pivot point 284 and the voltage amplification system 254. FIG. 11 depicts the orientation of the movable element 251 during conventional use by a user whereby the center of mass 257 is situated generally below the pivot point 284, i.e., spaced in a downward direction from the pivot point 284 (with respect to the intended orientation of the belt apparatus 202 when in use). As such, when the buckle 226 is stationary and at rest in a horizontal orientation from the perspective of FIG. 10, the center of mass 257 causes the movable element 251 to remain generally in a vertical orientation from the perspective of FIG. 11, it being understood that the movable element 251 is depicted in FIG. 11 as not being vertically oriented, and rather is depicted as being in motion in a counter-clockwise direction from the perspective of FIG. 11.

In this regard, it can be understood that the center of mass 257 further enables the movable element 251 to be inertially movable, i.e., movable based upon the inertia of the movable element 251 which can be characterized as being disposed generally at the center of mass 257. Movement of the buckle 226 will thus result in movement of the movable element 251 with respect to the buckle 226 as will be set forth in greater detail below.

The control apparatus 234 further includes a number of fall detection elements 258 which, in addition to the movable element 251, include a plurality of contacts 262A, 262B, 262C, 262D, and 262E, which may be individually or collectively referred to herein with the numeral 262. The contacts 262 are situated on a support 264 that is of a semi-spherical shape whereby the contacts 262 themselves are each in the shape of a spherical sector, and with the pivot point 284 being the center of the various spherical sector shapes of the contacts 262. The contacts 262 are electrically conductive and are each connected with a corresponding one of the protective devices 236. Each contact 262 in appropriate circumstances communicates to its corresponding protective device 236 a trigger signal from the generator apparatus 248 in a fashion that will be set forth in greater detail below.

As can be understood from FIGS. 11 and 13, the generator apparatus 248 includes an additional conductor 272 that is situated adjacent but spaced (as at the numeral 266 in FIG. 13) from the contacts 262. The additional conductor 272 has a free end 275 and is formed of a lightweight and flexible material that is electrically conductive, such as a thin layer of metal. The additional conductor 272 potentially may be elastically deformable between a free state, such as is depicted generally in FIG. 11 wherein the free end 275 is spaced a first distance 266 from the contacts 262, and an elastically deflected state wherein the free end 275 is relatively closer to one of the contacts 262. Such elastic deformation could result from centripetal acceleration or may result from a potential difference between the free end 275 and an adjacent contact 262. Such elastic deformation could likewise result from the another magnetic field that is formed in the movable element 251 as a result of the voltage being induced therein if the contacts 262 are formed of a ferromagnetic material such as soft iron. That is, the proximity of the free end 275 and the another magnetic field existent therein to one of the contacts 262, if ferromagnetic, may magnetically cause the free end 275 to deform toward the contact 262. Such deformation could result from other phenomena. It is noted, however, that in the absence of a falling event such as would cause an arc 290 to be formed between the free end 275 and one of the contacts 262, the free end 275 is spaced as at 266 from the contacts whereby the two are advantageously free from frictional wear therebetween. The space 266 may be on the order of 1/32 of an inch, but other dimensions may be appropriate depending upon the circumstances of the application.

The belt apparatus 202 further includes a set of electrical leads 288A, 288B, 288C, 288D, and 288E, which may be referred to herein individually or collectively with the numeral 288. The leads 288A, 288B, 288C, 288D, and 288E are each connected at one end thereof with the contacts 262A, 262B, 262C, 262D, and 262E, respectively, and are connected at their opposite end with the protective devices 236A, 236B, 236C, 236D, and 236E, respectively. As will be described in greater detail below, the leads 288 communicate directional trigger signals from the contacts 262 to the protective devices 236 to energize and otherwise activate one or more of the protective devices 236. The belt apparatus 202 further includes a ground lead 292 that extends between all of the protective devices 236 and the voltage amplification system 254. When the conductor 252 moves through the magnetic field generated by the magnetic apparatus 242 at a rate that is sufficiently fast to cause the voltage that is induced in the conductor 252 to reach a predetermined value, the voltage amplification system 254 communicates to the additional conductor 272 a triggering signal which is communicated in the form of an electrical arc 290 that forms between the free end 275 of the additional conductor 272 and one of the contacts 262.

More specifically, the voltage that is induced in the conductor 252 itself during pivoting of the conductor 252 through the magnetic field is likely to be insufficient in magnitude to cause an electrical arc between the free end 275 and one of the conductors 262. In the depicted exemplary embodiment, however, the voltage induced in the conductor 252 is communicated to the voltage amplification system 254 which amplifies the voltage to an increased level. Depending upon the velocity of the conductor 252, the increased voltage can form the electrical arc 290 between the free end 275 and one of the contacts 262. In such a situation, the electrical arc 290 is operable to energize one of the protective devices 236.

The exemplary voltage amplification system 254 operates generally in the fashion of an ignition coil of an older automobile or motorcycle, although other implementations of the voltage amplification system 254 can be envisioned within the scope of the present concept. As is generally understood, an ignition coil includes a primary winding and a secondary winding that are formed on a discontinuous iron core. The primary windings operate as an inductor and have a capacitor connected therewith whereby the inductor and capacitor together behave as a tuned circuit. One lead of the secondary winding is connected with the additional conductor 272, and the other lead of the secondary winding is, in the depicted exemplary embodiment, connected with the ground lead 292. In a well understood fashion, when the conductor 252 moves through the magnetic field with a sufficient velocity, the voltage that is induced in the conductor 252 is of a sufficient voltage that, when supplied to the voltage amplification system 254, results in an amplified voltage being supplied to the additional conductor 272. Such amplified voltage is of a magnitude sufficient to form the electrical arc between the free end 275 and one of the contacts 262. Such electrical arc 290 operates as a directional triggering signal which energizes and thus inflates the particular protected device 236 that is connected (by one of the leads 288) with the contact 262 that had received the electrical arc 290.

As can be understood from FIG. 11, movement of the support 264 (which is situated on the buckle 226), such as in the direction indicated by the arrow 291A in FIG. 11, causes corresponding inertia-based movement of the movable element 251 in a corresponding fashion, such as is indicated at the arrow 291B in FIG. 11. It can be understood that ordinary and low velocity pivoting of the movable element 251 with respect to the brace 274 indicates ordinary movement by the user, such as walking, climbing stairs, moving between sitting and standing positions, and the like, all of which are expected in the daily life of the user. However, a falling event will result in a relatively rapid movement of the buckle 226 and the support 264 situated thereon, with correspondingly rapid inertial movement of the movable element 251 with respect thereto and corresponding movement of the conductor 252. If the rate of movement of the conductor 252 within the magnetic field is of sufficient magnitude to be the result of a falling event, the voltage that is induced in the conductor 252 and that is communicated to the voltage amplification system 254 will be amplified or otherwise increased in value by the voltage amplification system 254. This will result in the electrical arc 290 being formed between the free end 275 and whichever of the contacts 262 the free end 275 is adjacent when the electrical arc 290 occurs. In this regard, the number of windings in the conductor 252 and the magnetic flux of the magnetic elements 249 are chosen such that the resultant voltage that is induced in the conductor 252 will be of sufficient magnitude in a falling event that when it is amplified by the voltage amplification system 254 it will form the electrical arc 290 and thereby energize the appropriate protective device 236. It may be desirable that the amplified voltage be of sufficient magnitude that it can energize two of the protective devices 236 if the falling event is in a direction that would desirably result in two adjacent protective devices 236 being energized simultaneously. FIG. 11 depicts the arc 290 extending between the free end 275 and the contact 262C, it being understood that FIG. 11 depicts the movable element 251 in a different position than it is depicted in FIG. 10.

It is understood that the movable element 251 is not only movable in the clockwise and counter-clockwise directions in FIG. 11 but, since the end of the brace 274 is spherical, the movable element 251 is additionally pivotable in directions into and out of the plane of the page of FIG. 11. By configuring the movable element 251 such that the center of mass 257 is spaced from the pivot point 284 in a direction generally toward the contacts 262 and in a direction generally downward from the pivot point 284 and in the direction of gravity, the inertial movement of the movable element 251 and thus the conductor 252 will cause the electrical arc 290 to be directed toward whichever of the contacts 262 is in the direction of the falling event that is being experienced by the user. The electrical arc 290 being delivered to a particular one of the contacts 262 thus serves as a directional trigger signal that triggers and thus energizes an appropriate one of the protective devices 236 in a fashion that protects the user from injury in a falling event. The control apparatus 234 thus advantageously serves as another example of a device that can selectively trigger one or more protective devices 236 in a fashion to protect an individual from injury in a falling event.

It is expressly noted that the various teachings of the various embodiments presented herein can be combinable with one another in any of a variety of fashions. By way of example, the magnetic apparatus 242 and the generator apparatus 248 could be employed in the control apparatus 134 in place of the power source 152. Still alternatively, the flexible support element 74 of the control apparatus 34 could be configured as a conductor formed from a plurality of windings that is movable through a magnetic field and which thus could take the place of the power source 52 therein. Other variations will be apparent to one of ordinary skill in the art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A control apparatus structured to electrically trigger at least a first device from among a number of devices, the control apparatus comprising:

a support;

a number of electrical contacts, at least some of the electrical contacts of the number of electrical contacts each being electrically connectable with a corresponding device from among a number of devices;

a magnetic apparatus comprising at least a first magnetic element that generates a magnetic field;

a generator apparatus comprising a movable element that is disposed on the support, the movable element comprising a conductor that is situated in proximity to the magnetic field;

responsive to movement of the support, the conductor being inertially movable with respect to the support and to have induced therein a voltage that is of a magnitude that varies with a velocity of the conductor through the magnetic field; and responsive to the voltage being of a predetermined magnitude, the generator apparatus energizing an electrical contact of the number of electrical contacts to thereby electrically trigger the corresponding device that is connected with the electrical contact.

2. The control apparatus of claim 1 wherein the movable element further comprises another conductor that is movable with respect to the support and that has a free end, the another conductor being elastically deflectable between a free state wherein the free end is spaced a first distance away from the number of electrical contacts and a deflected state wherein the free end is situated relatively closer to the number of electrical contacts and energizes an electrical contact of the number of electrical contacts.

3. The control apparatus of claim 1 wherein the movable element is pivotable about a pivot point with respect to the support, and wherein the number of electrical contacts are situated in a partially spherical arrangement whose center is the pivot point.

4. The control apparatus of claim 3 wherein the movable element has a center of mass that is spaced from the pivot point.

5. The control apparatus of claim 3 wherein the magnetic apparatus comprises a plurality of magnetic field elements that include the at least first magnetic element, the plurality of magnetic field elements being arranged in another partially spherical arrangement whose center is the pivot point and which is opposite the number of electrical contacts.

6. The control apparatus of claim 5 wherein the north poles of the plurality of magnetic field elements together point one of toward the pivot point or away from the pivot point.

7. The control apparatus of claim 1 wherein the movable element is spaced from the number of electrical contacts and energizes the electrical contact via an electrical arc between the movable element and the electrical contact.

8. The control apparatus of claim 7 wherein the generator apparatus further comprises a voltage amplification system to which the voltage is applied and that outputs another voltage that is relatively higher than the voltage and that causes the electrical arc.

9. The control apparatus of claim 1 wherein the conductor is elongated.

10. The control apparatus of claim 1 wherein the conductor comprises a plurality of windings within which the voltage is induced.

11. A belt apparatus comprising the control apparatus of claim 1 and being structured to support a pair of trousers having a number of belt loops, the belt apparatus further comprising:

a trouser support apparatus comprising an elongated and flexible belt element having a number of cavities formed therein and being structured to extend through at least some of the number of belt loops of the pair of trousers and to assist in supporting at least a portion of the pair of trousers at the waist of a user, the trouser support apparatus further comprising a fastener structured to be cooperable with the belt element to retain the belt element at a selected circumferential length;

a protection apparatus comprising a number of cushion elements that are each structured to be movable from a collapsed configuration situated within a cavity of the number of cavities to an expanded configuration situated at least partially outside the cavity and in protective proximity to a body part of the user;

the generator apparatus energizing an electrical contact responsive to a falling event of the user; and an expansion apparatus which, responsive to the trigger signal, expands as the corresponding device at least a first cushion element of the number of cushion elements from the collapsed configuration to the expanded configuration.

12. The belt apparatus of claim 11 wherein the control apparatus is structured to detect as the falling event a falling event in a particular direction with respect to the user and is further structured to output as the trigger signal a directional trigger signal which causes the expansion apparatus to expand as the at least first cushion element one or more cushion elements that are situated generally in the particular direction with respect to the user.

13. The belt apparatus of claim 12 wherein the control apparatus is structured to output as the directional trigger signal a signal which causes the expansion apparatus to expand as the at least first cushion element fewer than all of the cushion elements.

14. The belt apparatus of claim 11 wherein the control apparatus is further structured to output as the trigger signal a delayed trigger signal that is output after a predetermined delay period which is subsequent to an initiation of the falling event but prior to the user striking the ground.

15. The belt apparatus of claim 11 wherein the belt element has a length that is significantly greater than its width, the width being significantly greater than its thickness.

16. The belt apparatus of claim 15 wherein the belt element comprises a number of frangible regions situated on or adjacent at least one elongated edge of the belt element, the frangible regions each having a lesser strength than another portion of the belt element and being situated in communication with the number of cavities and which, upon movement of one or more of the number of cushion elements toward the expanded configuration, are structured to form openings between the exterior of the belt element and one or more of the number of cavities that correspond with the one or more of the number of cushion elements through which the number of cushion elements in the expanded configuration extend.

* * * * *